US007966932B2

(12) United States Patent
Gieser et al.

(10) Patent No.: US 7,966,932 B2
(45) Date of Patent: Jun. 28, 2011

(54) SHEET-FED OFFSET PRINTING PRESS AND METHOD OF PRINTING MULTIPLE COLORS ON BOTH SIDES OF SHEETS

(75) Inventors: Michael Gieser, Oftersheim (DE); Norbert Rodi, Bad Schönborn (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 902 days.

(21) Appl. No.: 11/879,704

(22) Filed: Jul. 18, 2007

(65) Prior Publication Data

US 2008/0017057 A1 Jan. 24, 2008

(30) Foreign Application Priority Data

Jul. 18, 2006 (DE) ..... 10 2006 033 104

(51) Int. Cl.

| | |
|---|---|
| ***B41F 23/00*** | (2006.01) |
| ***B41F 23/04*** | (2006.01) |
| ***B41F 23/08*** | (2006.01) |
| ***B41F 5/18*** | (2006.01) |
| ***B05C 11/00*** | (2006.01) |
| ***B05C 1/08*** | (2006.01) |

(52) U.S. Cl. ..... 101/183; 101/231; 101/232; 101/424.1; 101/490; 101/177; 118/46; 118/66; 118/255

(58) Field of Classification Search ..... 101/174, 101/177, 211, 424.1, 183, 229–232, 490; 118/46, 223, 620, 641–643, 66, 226, 236, 118/255

See application file for complete search history.

(56) References Cited

U.S. PATENT DOCUMENTS

| | | | | |
|---|---|---|---|---|
| 5,213,035 | A * | 5/1993 | Becker | 101/230 |
| 5,873,309 | A * | 2/1999 | Mack et al. | 101/424.1 |
| 5,944,898 | A * | 8/1999 | Mendez | 118/641 |
| 6,038,976 | A * | 3/2000 | Helmstadter et al. | 101/410 |
| 6,338,299 | B1 | 1/2002 | Kamoda et al. | 101/424.1 |
| 6,388,299 | B1 * | 5/2002 | Kang et al. | 257/415 |
| 6,718,908 | B1 | 4/2004 | Bayer et al. | 118/46 |
| 6,772,709 | B2 * | 8/2004 | Shibata | 118/46 |

FOREIGN PATENT DOCUMENTS

| | | |
|---|---|---|
| DE | 42 13 024 A1 | 10/1993 |
| DE | 296 23 064 U1 | 11/1997 |
| DE | 203 03 901 U1 | 6/2003 |
| DE | 199 52 204 B4 | 2/2004 |
| EP | 0 976 555 A1 | 2/2000 |
| EP | 1 117 487 B1 | 7/2002 |

* cited by examiner

*Primary Examiner* — Leslie J Evanisko
*Assistant Examiner* — Marissa L Ferguson-Samreth
(74) *Attorney, Agent, or Firm* — Laurence A. Greenberg; Werner H. Stemer; Ralph E. Locher

(57) ABSTRACT

A sheet-fed offset printing press for printing multiple colors on both sides of sheets, preferably on sheets of paper, includes a first row of in-line printing units for printing a first side of the sheet, followed by a reversing device, followed by a second row of in-line printing units for printing the other side of the sheets, and followed by one or more varnishing units that are disposed in such a way, or include varnishing blanket cylinders that are disposed in such a way, that the front sides and the back sides of the passing sheets are varnished. A further reversing device is inserted between two varnishing units. A method of printing multiple colors on both sides of sheets is also provided.

20 Claims, 5 Drawing Sheets

SHEET-FED OFFSET PRINTING PRESS AND METHOD OF PRINTING MULTIPLE COLORS ON BOTH SIDES OF SHEETS

CROSS-REFERENCE TO RELATED APPLICATION

This application claims the priority, under 35 U.S.C. §119, of German Patent Application DE 10 2006 033 104.4, filed Jul. 18, 2006; the prior application is herewith incorporated by reference in its entirety.

BACKGROUND OF THE INVENTION

Field of the Invention

The invention relates to a sheet-fed offset printing press for double-sided multicolor printing, preferably on sheets of paper. The printing press includes a first row of printing units disposed directly in line to print on a first side of the sheet, followed by a reversing device, which is in turn followed by a second row of printing units disposed in line to print on the other side of the sheet, and finally by one or more varnishing units. In-line printing presses of that type, which include one or more varnishing units provided at the end of the press for varnishing the sheet side that was printed last, are known and are available from a number of manufacturers. The invention also relates to a method of printing multiple colors on both sides of sheets.

German Published, Non-Prosecuted Patent Application DE 42 13 024 A1 proposes varnishing both sides of the printed sheets in one machine run, i.e. in line, in presses of the type indicated above. For that purpose, a varnishing unit and a dryer are provided upstream of the reversing device in the printing press. Thus, the first side of the sheet is varnished and dried before the sheet is reversed and printed on the second side.

In that press, the first side of the sheet is varnished before the sheet passes the printing nips of the perfecting units. Consequently, the shine effect created on the sheet surface as a result of the varnishing operation is reduced: the more perfecting units or printing nips that are present, the less shine remains. In addition, problems occur in particular when the varnish applied to the first side of the sheet has not dried completely in the drying device. In that case, the surfaces of impression cylinders in the perfecting unit, which are optimized for contact with oil-based offset printing units, may become soiled by residual varnish, mixed with paper dust etc., which means that they will have to be cleaned in a time-consuming process.

In another type of known printing press, described in European Patent Application EP 0 976 555 A1, corresponding to U.S. Pat. No. 6,338,299, for example, the sheet is printed with offset printing inks alternatingly by printing units that are disposed above and below the path of paper travel. Subsequently, the sheet is varnished on both sides by varnishing units respectively disposed above and below the path of paper travel. Apart from the fact that that type of printing press is not very common because access to the printing units below the path of paper travel is difficult, those presses have the following problem: when the last color is printed onto the second side, the sheet has already passed all of the printing nips. In comparison with a press that prints first on one side and then on the other side completely, the printed image is widened to a greater extent (fan-out effect) because the sheet passes through twice the number of printing nips, and it is impossible to compensate for that effect by register adjustment.

In addition to in-line varnishing units, there are separate, stand-alone varnishing devices known in the art to varnish both sides of printed sheets. As is described in European Patent Application EP 1 117 487 A1, corresponding to U.S. Pat. No. 6,718,908, such varnishing devices may also include reversing devices. However, a disadvantage of stand-alone varnishing devices is that the sheets must first be formed into a pile and then be fed to the varnishing device individually. When they are fed to the varnishing device, the sheets coming from the delivery pile of the printing press have already been powdered, a fact which may be detrimental to the shine effect created by the varnishing operation and may otherwise cause difficulties. In addition, stand-alone varnishing devices require more space and more equipment than an in-line construction because two feeders and two deliveries are necessary.

SUMMARY OF THE INVENTION

It is accordingly an object of the invention to provide a sheet-fed offset printing press and a method of printing multiple colors on both sides of sheets, which overcome the hereinafore-mentioned disadvantages of the heretofore-known devices and methods of this general type and which produce high-quality sheets that are printed and varnished on both sides in an in-line process.

With the foregoing and other objects in view there is provided, in accordance with the invention, a sheet-fed offset printing press for double-sided multi-color printing on sheets, preferably sheets of paper. The printing press comprises a first row of in-line printing units for printing on a first side of the sheets, a reversing device disposed downstream of the first row of in-line printing units, a second row of in-line printing units, disposed downstream of the reversing device, for printing on a second side of the sheets, at least two varnishing units disposed downstream of the second row of in-line printing units. The at least two varnishing units have varnishing blanket cylinders causing the front sides and the back sides of the sheets passing through to be varnished. A further reversing device is fitted between the at least two varnishing units.

With the objects of the invention in view, there is also provided a method of printing multiple colors on both sides of the sheets, preferably sheets of paper. The method comprises:

a) individually feeding sheets in a sheet pile to a number of in-line printing units and printing on a front side of the sheets;
b) then turning the sheets having been printed in the in-line printing units and printing multiple colors on a back side of the sheets in a row of further in-line printing units;
c) then applying one or more coats of varnish to the printed back side of the sheets;
d) then turning the sheets and subsequently varnishing the front side of the sheets having been printed first; and
e) then delivering the sheets having been printed and varnished on both sides to a pile or for further processing.

Thus, according to the invention, the sheets are initially printed on both sides before they are varnished, and the sheet is turned between the varnishing of the front side and the varnishing of the back side. In a sheet-fed printing press of such a construction, it is possible to produce sheets that are varnished on both sides in an in-line process without the difficulties explained in the introduction. A greater degree of glossiness can thus be achieved on both sides of the sheet, and the cylinder surfaces and cylinder jackets in the perfecting unit can be optimized for contact with oil-based ink without the necessity of special cleaning operations.

Other features which are considered as characteristic for the invention are set forth in the appended claims.

Although the invention is illustrated and described herein as embodied in a sheet-fed offset printing press and a method of printing multiple colors on both sides of sheets, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1A:
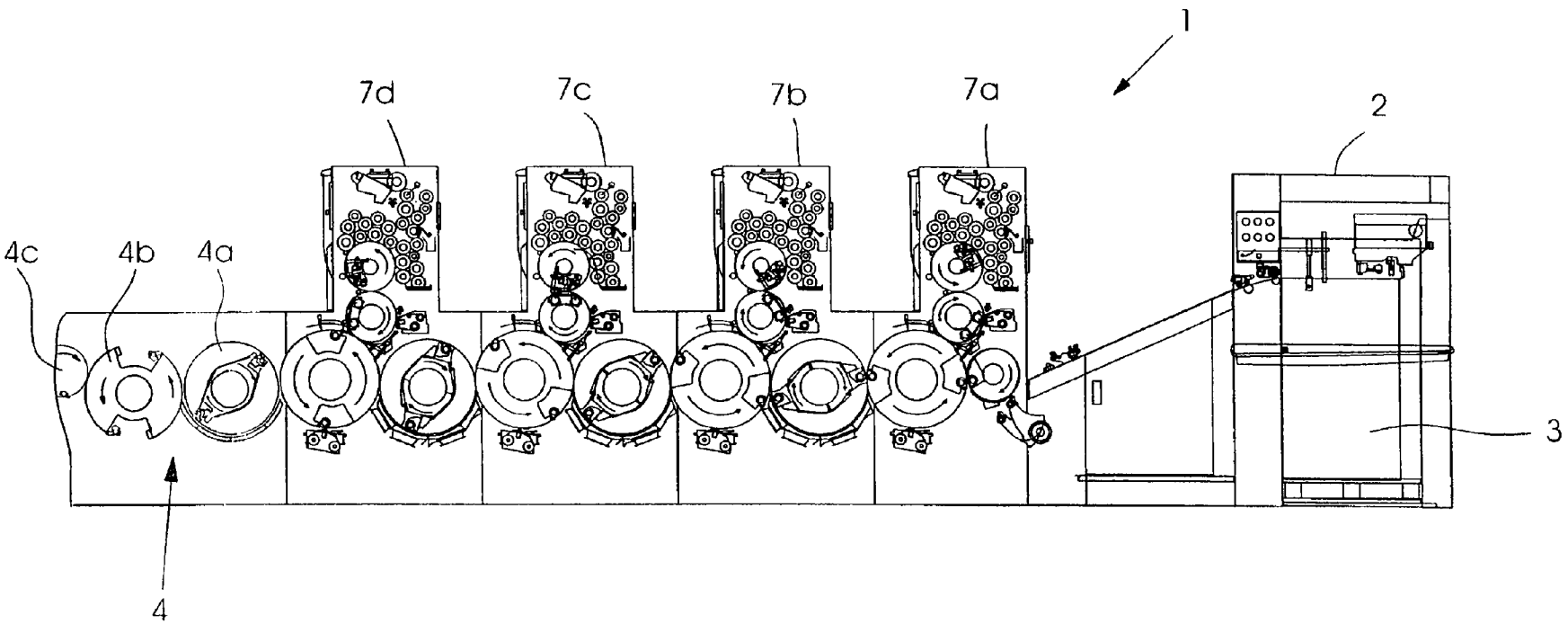
FIG. 1A is a fragmentary, diagrammatic, longitudinal-sectional view of a straight-printing portion in an in-line sheet-fed offset printing press.
Figure 1B:
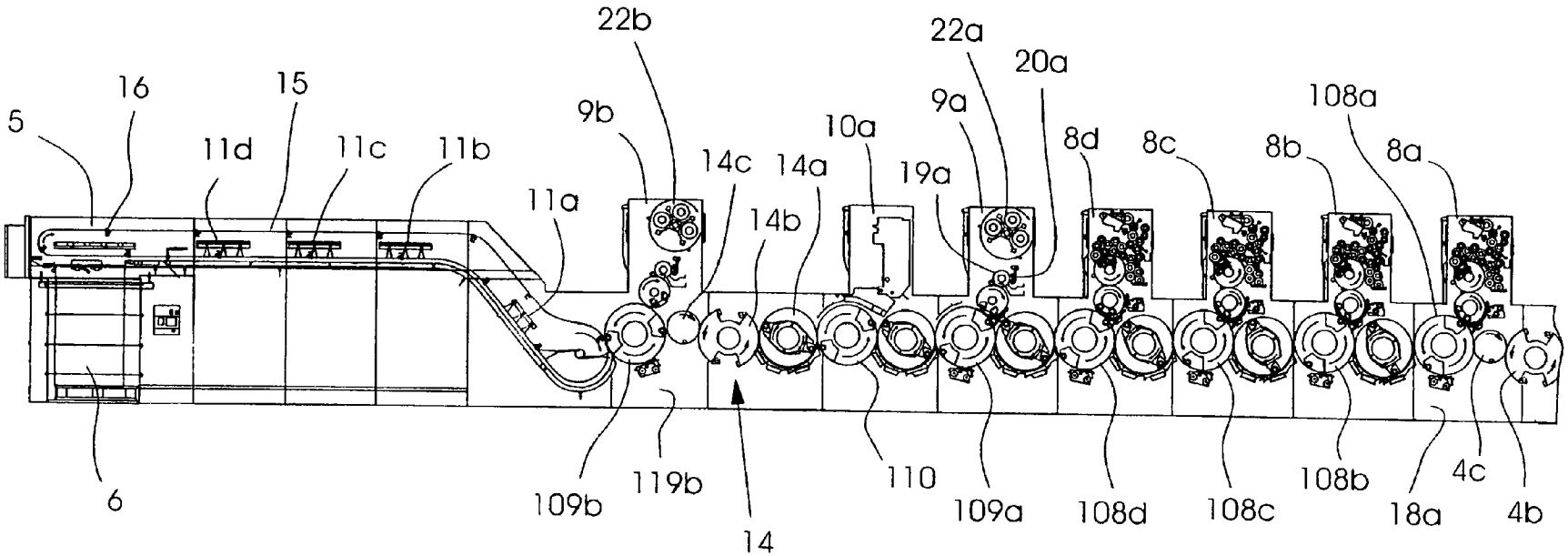
FIG. 1B is a fragmentary, longitudinal-sectional view of a perfecting portion in the in-line sheet-fed offset printing press, which is to be placed to the left of FIG. 1A.

Referring now to the figures of the drawings in detail and first, particularly, to FIG. 1A thereof, there is seen a first portion of an offset printing press 1 of in-line construction, including a feeder 2 holding a pile 3 of unprinted paper and four printing units 7*a-d* for the four process colors. The four printing units 7*a* to 7*d* form a straight-printing portion of the press 1, i.e. the portion that prints the front or first side of the sheets. The fourth printing unit 7*d* is followed by a first reversing device 4 that operates in accordance with the three-drum reversing principle. The reversing device 4 is formed of a feed drum 4*a*, a storage drum 4*b*, and a reversing drum 4*c*. A second portion of the press, i.e. the portion in which the back or second side of the sheets is printed, is shown in FIG. 1B. The drum 4*c* is supported in side frames 18*a* of a first perfecting unit 8*a* following the reversing device 4. The reversed sheet is transferred to an impression cylinder 108*a* of the first perfecting unit 8*a*. Four perfecting units 8*a-d* are followed by a first varnishing unit 9*a* of the chambered doctor-blade type, i.e. the varnishing unit 9*a* includes a screen cell roller 19*a* and a chambered doctor blade 20*a* containing aqueous dispersion varnish. Reference numeral 22*a* designates what is referred to as a "screen roller star", which includes three further screen rollers with cells of different sizes. These three further screen rollers can be exchanged for the screen roller 19*a* to determine the amount of varnish to be applied. The entire surface of the second side of the sheet is coated with an aqueous dispersion varnish in the varnishing unit 9*a* on an impression cylinder 109*a*.

The varnishing unit 9*a* is followed by a drying tower 10*a*. The second side of the passing sheet is dried in the region of a cylinder 110 by hot air and IR light in the drying tower.

Downstream of the drying tower 10*a*, as viewed in the direction of sheet travel, there is a second reversing device 14 that is of substantially identical construction to the first reversing device 4. The reversing device 14 likewise includes three drums 14*a, b*, and *c*. In this case, the reversing drum 14*c* is supported in side walls 119*b* of a second varnishing unit 9*b* following the reversing device 14 and transfers the sheet to an impression cylinder 109*b* of the varnishing unit 9*b*. The varnishing unit 9*b* is of the same type as the varnishing unit 9*a* and is likewise used to coat the entire surface of the first side of the sheet with an aqueous dispersion varnish.

The varnishing unit 9*b* is followed by a delivery 5 of the printing press. The delivery 5 includes revolving gripper bars driven by a chain conveyor 15. These gripper bars 16 take over the sheets that have been varnished in the unit 9*b* and guide them through dryer sections 11*a, b, c* and *d*, where the first side of the sheets is likewise dried by IR light and/or hot air to harden the dispersion varnish. The sheets, which have been varnished on both sides in this way, are then deposited on a sheet pile 6 in the delivery 5.

While the sheets are transported through the printing units 7*a-d* and 8*a-d*, the printed sheets do not come into contact with varnish. Surfaces of sheet-guiding impression cylinders 108*a-d* in the printing units 8*a-d* and guide plates of the transfer devices disposed between the printing units 8*a-d* may thus be coated with ink-repellent layers that are adapted to or optimized in terms of the properties of the oil-based offset inks. The viscous dispersion varnish that causes soiling is not introduced until the end of the press, when the process of printing with offset printing ink is completed. Thus, compared to configurations wherein the varnishing unit is located upstream of the first reversing device 4, the useful life of the cylinder jackets and the intervals between cleaning operations can be increased to a considerable extent.

The reversing device 4 is convertible, i.e. it can be switched between straight or front-side printing mode and perfecting mode as described e.g. in German Published Patent Application DE 41 31 273 A1. The same applies to the reversing device 14. Due to this variability, the printing press 1 can print a wide variety of different jobs. If both reversing devices 4 and 14 are switched to straight printing, a number of special or spot colors can be printed on the first side of the sheets in the printing units 8 of the perfecting module. The printing unit 8*d* can additionally apply a transparent, oil-based dull varnish onto certain areas in the printed image, which will then be coated with two layers of a high-gloss dispersion varnish on top of each other in the varnishing units 9*a* and 9*b*. In this manner, high-quality paper board containers printed on one side may be produced, for example for packaging.

Once it has been switched to the straight printing mode, in particular the convertible reversing unit 14 disposed between the two varnishing units 9*a* and 9*b* also offers the possibility of applying a dispersion varnish as a primer in the first varnishing unit 9*a* to cover or "seal off" the offset inks underneath to avoid direct contact and thus chemical reactions between the offset inks and the high-gloss UV varnishes that will be printed in the second varnishing unit.

Another possibility is the application of gold varnish, for example in the first varnishing unit 9*a*, and the subsequent coating of the entire surface of the printed sheet with a protective varnish in the second varnishing unit 9*b*.

Once switched to the straight printing mode, it is additionally possible to apply a clear varnish to the printed sheet in the first varnishing unit 9*a* and to subsequently dry the clear varnish before metallic varnishes are applied in the second varnishing unit 9*b*. This may be done to prevent the offset inks printed on the sheet from marking the varnishing plate in the varnishing unit.

Figure 2:
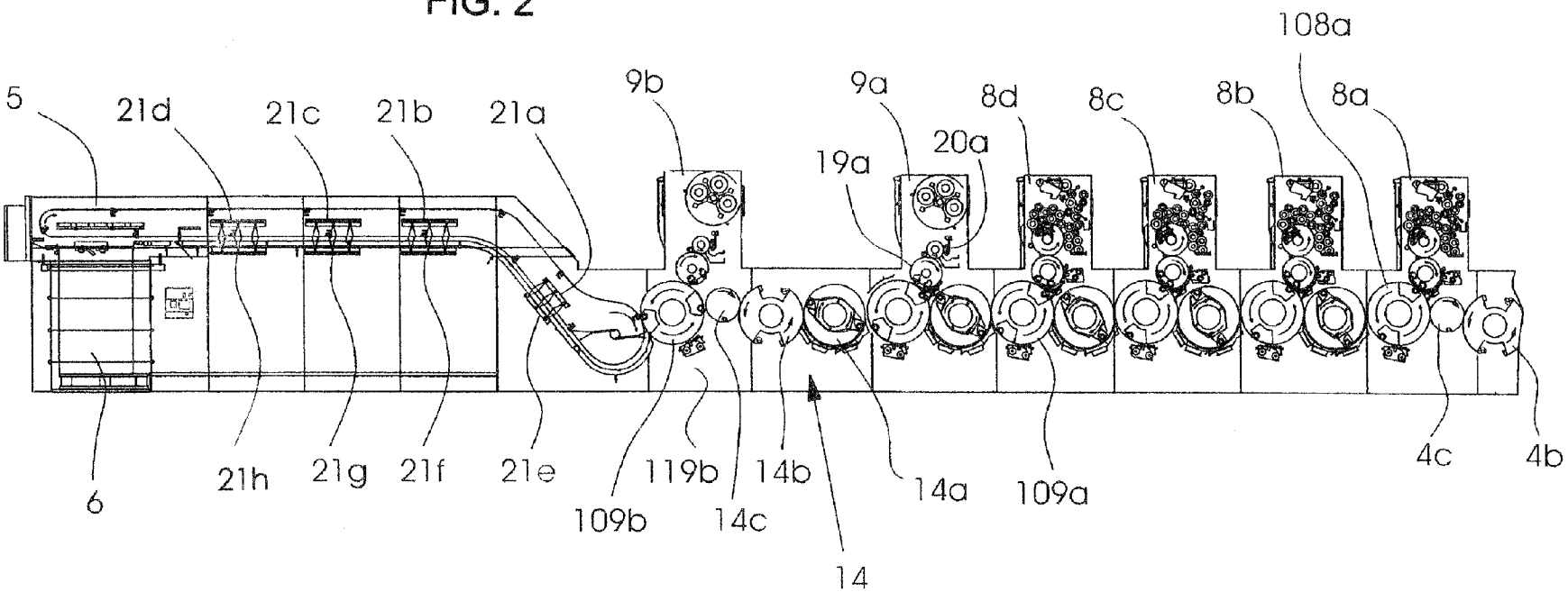
FIG. 2 is a fragmentary, longitudinal-sectional view of a second exemplary embodiment of the perfecting portion of the printing press as shown in FIG. 1B.

In the exemplary embodiment shown in FIG. 2, the perfecting portion of the printing press described above with reference to FIGS. 1A and 1B has been modified. In FIG. 2, the drying tower 10*a* of FIG. 1B has been eliminated, which means that the sheet exiting the varnishing unit 9*a* is turned over in the reversing device 14 while it is still wet. Downstream of the second varnishing unit 9*b*, in which the first side is varnished, the sheet, which has now been varnished on both sides, passes through four dryer modules 21*a-h*, in which the sheet is dried from both sides, i.e. from above and from below, by IR light and hot air. For this purpose, dryers 21*e* to *h*, which are integrated into the sheet guiding system of the delivery 5, may be used, as described in German Published, Non-Prosecuted Patent Application DE 10 2005 042 956 A1.

Since the separate drying tower is dispensed with, the press is shorter and requires less floor space than the press described with reference to the exemplary embodiment shown in FIG. 1B.

Figure 3:
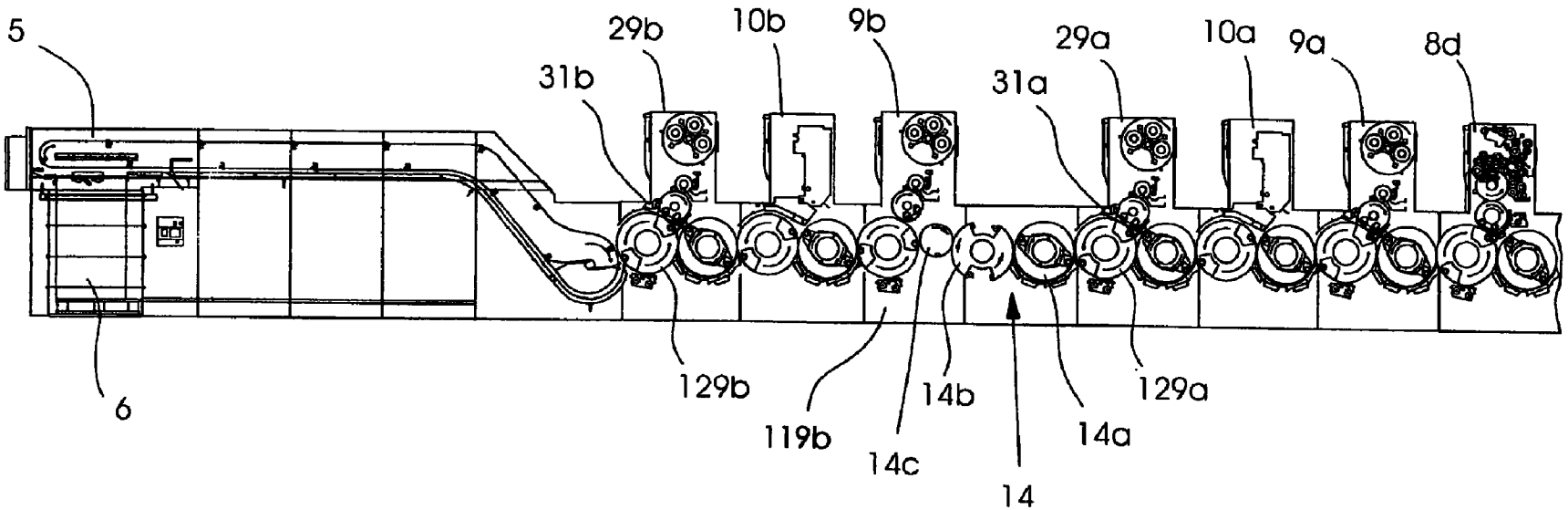
FIG. 3 is a fragmentary, longitudinal-sectional view of a third exemplary embodiment of the perfecting portion of the printing press as shown in FIG. 1B.

In the exemplary embodiment of FIG. 3, the last printing unit 8*d* of the perfecting portion of the printing press 1 is followed by four varnishing units. The first varnishing unit 9*a* is of the screen roller type and applies an effect varnish onto the second side that is to be varnished. The effect varnish is dried in the following drying tower 10*a*. The latter is followed by a varnishing unit 29*a*, for example for UV varnish, in which the entire surface of the second side of the sheet is coated with a high-gloss transparent protection varnish. The reversing device 14 is then followed by an identical configuration of a varnishing unit 9*b* for effect varnish, a drying tower 10*b*, and a varnishing unit 29*b*, which applies the high-gloss protection varnish to the first side of the sheet. Intermediate-level dryers 31*a* and 31*b* disposed directly above impression cylinders 129*a* and 129*b* of the varnishing units 29*a* and 29*b* harden the UV varnish by UV light of the appropriate wavelength. In this embodiment, the dryer sections in the delivery 5 can be dispensed with.

When the reversing device 14 of this machine is converted from the perfecting mode to the straight printing mode, either the front side or the back side, depending on the setting of the first reversing device 4, may be printed with four different layers of varnish on top of each other. Thus, highly specialized high-quality printed products can be produced, for example by printing a dispersion varnish in the first varnishing unit to cover and seal off the entire surface of the sheet that has been printed with offset ink, then gold varnish onto the dispersion varnish, and subsequently, in the third varnishing unit, a dull varnish to create a dull finish. The dull varnish, like the gold varnish, may only be applied to certain areas of the image (spot varnishing). In the fourth varnishing unit, the entire sheet is subsequently coated with a high-gloss UV varnish.

Figure 4:
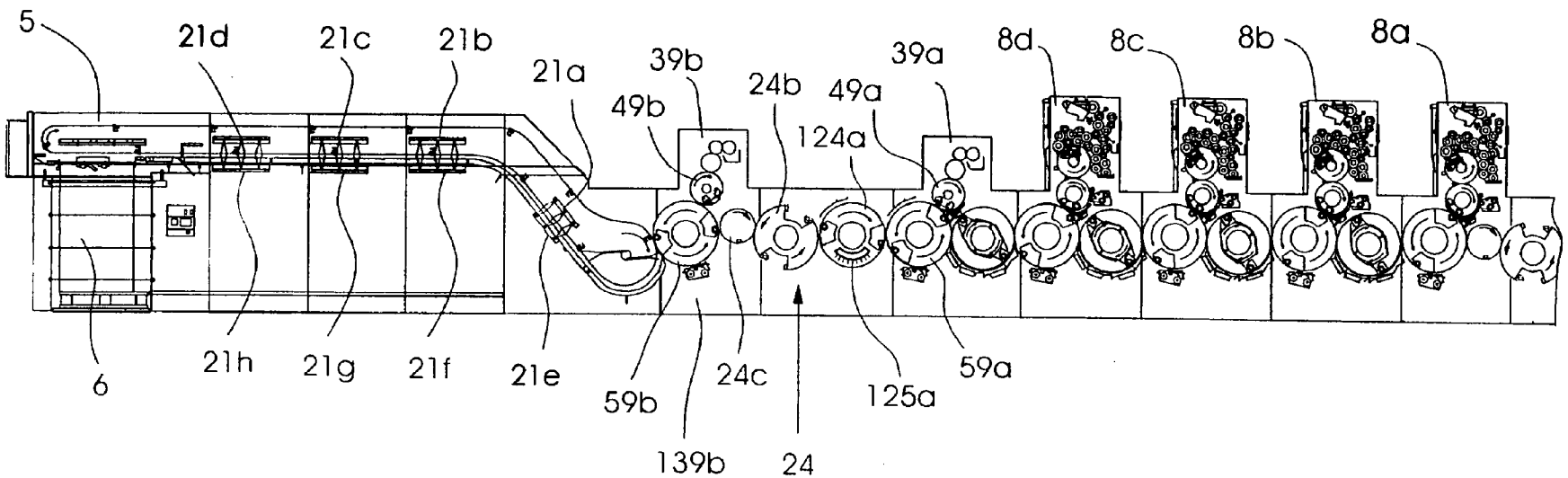
FIG. 4 is a fragmentary, longitudinal-sectional view of an end of the press following the last printing unit of a fourth exemplary embodiment of the perfecting portion of the printing press as shown in FIG. 1B.

In the exemplary embodiment illustrated in FIG. 4, the last printing unit 8*d* of the perfecting portion is followed by a first varnishing unit 39*a* of the fountain-roller type. An applicator roller 49*a* of this varnishing unit 39*a* applies an aqueous dispersion varnish onto the second side of the sheet. An impression cylinder 59*a* of the varnishing unit 39*a* is followed by a transport drum 124*a*, which also acts as a feeder drum of a reversing device 24. An IR dryer 125*a*, which applies IR light and hot air to the sheet resting on the drum 124*a* or rather its concave inner side, is disposed inside the drum 124*a*. The drum 124*a* is constructed as a frame structure so that the radiation and, if applicable, the air used for the drying operation, can reach the surface of the sheet.

The drum 124*a* is then followed by a storage drum 24*b* and a reversing drum 24*c* of the reversing device 24, which is followed by a second varnishing unit 39*b* of the fountain-roller type having side walls 139*b* supporting the reversing drum 24*c*. A varnish applicator cylinder 49*b* of the latter varnishing unit now varnishes the first side of the sheets on an impression cylinder 59*b*. This varnishing unit 39*b* is then followed by the delivery 5, having gripper bars which take over the sheets that have now been varnished on both sides. The dryer modules 21*a-h* in the delivery 5 act on both sides of the sheets to dry the first side and to expel any residual wetness in the layer of varnish of the second side of the sheet.

The machine described in terms of this exemplary embodiment requires less floor space because the number of sheet-guiding cylinders can be reduced since the sheets are dried from inside the cylinder 124*a*.

In addition to the exemplary embodiments described herein, further modifications and variations are possible. Depending on the type of varnish that is used, it is possible to use a varnishing unit with a fountain roller instead of a varnishing unit with a chambered doctor blade. Moreover, it is of course possible to provide additional printing units for printing, for example, two spot or special colors on each side of the sheets rather than to have only four printing units for the four process colors both in the straight printing portion and in the perfecting portion of the press.

The invention claimed is:

1. A sheet-fed offset printing press for double-sided multicolor printing on sheets, the printing press comprising:

a first row of in-line printing units for printing on a front side of the sheets;

a reversing device disposed downstream of said first row of in-line printing units;

a second row of in-line printing units, disposed downstream of said reversing device, for printing on a back side of the sheets;

a first varnishing unit disposed downstream of said second row of in-line printing units, said first varnishing unit downstream of said second row of in-line printing units having varnishing blanket cylinders causing the back side of the sheets passing through to be varnished;

a further reversing device disposed downstream of said first varnishing unit; and a second varnishing unit disposed downstream of said further reversing device and having varnishing blanket cylinders causing the front side of the sheets passing through to be varnished.

2. The printing press according to claim 1, which further comprises a dryer unit disposed upstream of said further reversing device, as viewed in sheet travel direction.

3. The printing press according to claim 1, which further comprises dryer devices disposed downstream of said second varnishing unit, as viewed in sheet travel direction, for drying both sides of the sheets having been varnished on both sides.

4. The printing press according to claim 1, which further comprises a drum transporting the sheets, and a dryer unit associated with at least one of said varnishing units and disposed inside said drum.

5. The printing press according to claim 1, wherein at least one of said reversing devices is convertible from reversing mode to straight-printing mode.

6. The printing press according to claim 1, wherein said second varnishing unit disposed downstream of said further reversing device has an impression cylinder receiving turned sheets.

7. The printing press according to claim 6, wherein second varnishing unit disposed downstream of said further reversing device has side walls, and said further reversing device has a reversing drum supported in said side walls.

8. The printing press according to claim 1, wherein at least one of said varnishing units is configured to apply water-based varnishes or dispersion varnishes.

9. The printing press according to claim 1, wherein at least one of said varnishing units includes a screen roller with a doctor blade.

10. The printing press according to claim 1, wherein the sheets are sheets of paper.

11. A method of printing multiple colors on both sides of sheets, the method comprising the following steps:

a) individually feeding sheets in a sheet pile to a number of in-line printing units and printing on a front side of the sheets;

b) then turning the sheets having been printed in the in-line printing units and printing multiple colors on a back side of the sheets in a row of further in-line printing units;

c) then applying one or more coats of varnish to the printed back side of the sheets after leaving the row of further in-line printing units;

d) then turning the sheets and subsequently varnishing the front side of the sheets having been printed first; and e) then delivering the sheets having been printed and varnished on both sides to a pile or for further processing.

12. The method according to claim 11, which further comprises drying the sheets once they have been varnished.

13. The method according to claim 12, which further comprises drying the varnished second sides of the sheets before the sheets are turned in step d).

14. The method according to claim 13, which further comprises, during the drying step, applying at least one of radiation or hot air to a sheet side facing a transport cylinder in a concave shape.

15. The method according to claim 14, which further comprises drying the sheets on both sides once they have been turned in step d).

16. The method according to claim 13, which further comprises drying the sheets on both sides once they have been turned in step d).

17. The method according to claim 12, which further comprises, during the drying step, applying at least one of radiation or hot air to a sheet side facing a transport cylinder in a concave shape.

18. The method according to claim 17, which further comprises drying the sheets on both sides once they have been turned in step d).

19. The method according to claim 12, which further comprises drying the sheets on both sides once they have been turned in step d).

20. The method according to claim 11, wherein the sheets are sheets of paper.

* * * * *